US008921675B2

(12) United States Patent
Gimpel et al.

(10) Patent No.: US 8,921,675 B2
(45) Date of Patent: Dec. 30, 2014

(54) ADJUSTABLE BRIDGE FOR STRINGED MUSICAL INSTRUMENT

(75) Inventors: Dudley Gimpel, Arroyo Grande, CA (US); Kevin Hendrickson, Atascadero, CA (US)

(73) Assignee: Ernie Ball, Inc., San Luis Obispo, CA (US)

( * ) Notice: Subject to any disclaimer, the term of this patent is extended or adjusted under 35 U.S.C. 154(b) by 400 days.

(21) Appl. No.: 13/530,320

(22) Filed: Jun. 22, 2012

(65) Prior Publication Data

US 2013/0152762 A1 Jun. 20, 2013

Related U.S. Application Data

(60) Provisional application No. 61/500,248, filed on Jun. 23, 2011.

(51) Int. Cl.
*G10D 3/04* (2006.01)

(52) U.S. Cl.
CPC ..... *G10D 3/04* (2013.01)
USPC ..... 84/298

(58) Field of Classification Search
USPC ..... 84/290, 297 R, 298, 267, 289
See application file for complete search history.

(56) References Cited

U.S. PATENT DOCUMENTS

| | | | | |
|---|---|---|---|---|
| 3,842,705 | A | 10/1974 | Woodard et al. | |
| 4,549,460 | A * | 10/1985 | Gressett et al. | 84/298 |
| 6,057,498 | A | 5/2000 | Barney | |
| 6,580,021 | B2 | 6/2003 | Barney | |
| 6,875,910 | B2 * | 4/2005 | Naimish | 84/298 |
| 7,087,828 | B2 | 8/2006 | Krieger | |
| 7,777,108 | B2 | 8/2010 | Vosough et al. | |
| 7,893,331 | B2 | 2/2011 | Klanner | |
| 2003/0226441 | A1 | 12/2003 | Barney | |
| 2009/0272246 | A1 | 11/2009 | Richter | |

* cited by examiner

*Primary Examiner* — Kimberly Lockett
(74) *Attorney, Agent, or Firm* — Leech Tishman Fuscaldo & Lampl LLP; Denton L. Andrson

(57) ABSTRACT

An adjustable bridge for a stringed instrument has a saddle housing defining a plurality of saddle slots and a saddle disposed within each saddle slot. Each saddle is axially adjustable within a saddle slot parallel to its instrument string and is firmly retained within a saddle slot by friction and/or by a tautly drawn instrument string disposed across the saddle. The adjustable bridge employs no springs, set screws, detents, removable screws or other removable fasteners.

20 Claims, 5 Drawing Sheets

ADJUSTABLE BRIDGE FOR STRINGED MUSICAL INSTRUMENT

RELATED APPLICATION

This application is a continuation of U.S. patent application Ser. No. 61/500,248, filed on Jun. 23, 2011, entitled "ADJUSTABLE BRIDGE FOR STRINGED MUSICAL INSTRUMENT," the entirety of which is incorporated herein by reference.

FIELD OF THE INVENTION

The invention is in the field of stringed instruments and, more specifically, to the field of adjustable bridges for stringed instruments.

BACKGROUND OF THE INVENTION

All stringed instruments use a bridge to support the instrument strings between the base of the instrument and the neck of the instrument.

Many stringed instrument bridges are constructed so as to be adjustable in a direction parallel the strings of the instrument. Adjustable bridges of the prior art, however, employ set screws, detents, springs, removable screws and/or other types of fasteners, and frequently require the use of tools. Such adjustable bridges of the prior art are therefore awkward and time-consuming for the user to effect desired adjustments.

In addition to the set screws, detents, springs, removable screws and/or other types of fasteners, adjustable bridges of the prior art typically require associated metal hardware. Such fasteners and other metal hardware are frequently viewed by the user as having a detrimental aesthetic effect on the appearance of the user's otherwise well-crafted wood instrument.

Moreover, such screws, detents, springs, removable screws, other types of fasteners and associated metal hardware add unwanted weight to the instrument and often result in unwanted vibrations and rattling noises within the instrument.

Accordingly, there is a need for an adjustable instrument string bridge which avoids the necessity of set screws, detents, springs, removable screws and other removable fasteners, and does not require the use of tools.

SUMMARY OF THE INVENTION

The invention satisfies this need. The invention is an improved adjustable bridge for a stringed instrument. The adjustable bridge comprises a saddle housing defining a plurality of saddle slots, and a saddle disposed within each saddle slot. Each saddle is axially adjustable within a saddle slot substantially parallel to its string, and is firmly retained within a saddle slot by friction and/or by a tautly drawn instrument string disposed across the saddle. The adjustable bridge employs no set screws, detents, springs, removable screws or other removable fasteners.

DRAWINGS

These and other features, aspects and advantages of the present invention will become better understood with reference to the following description, appended claims and accompanying drawings where:

DETAILED DESCRIPTION OF THE INVENTION

Figure 1:
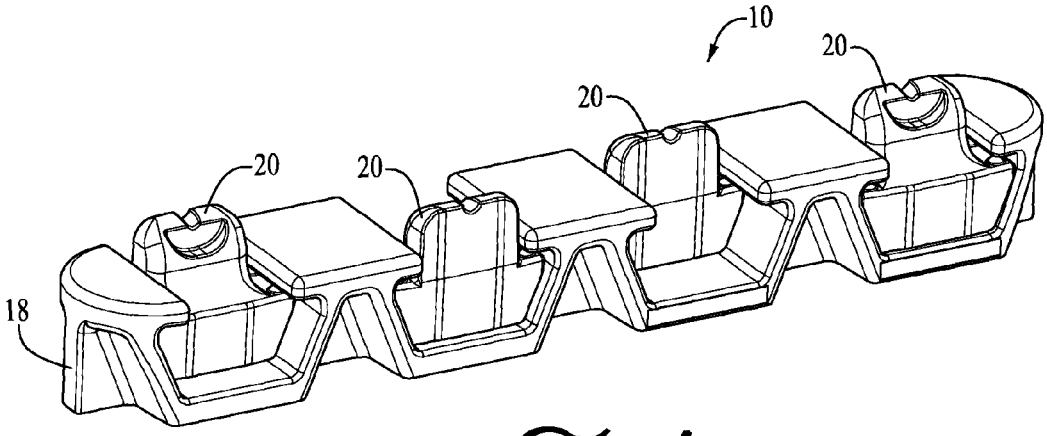
FIG. 1 is a perspective view of an adjustable bridge having features of the invention.
Figure 2:
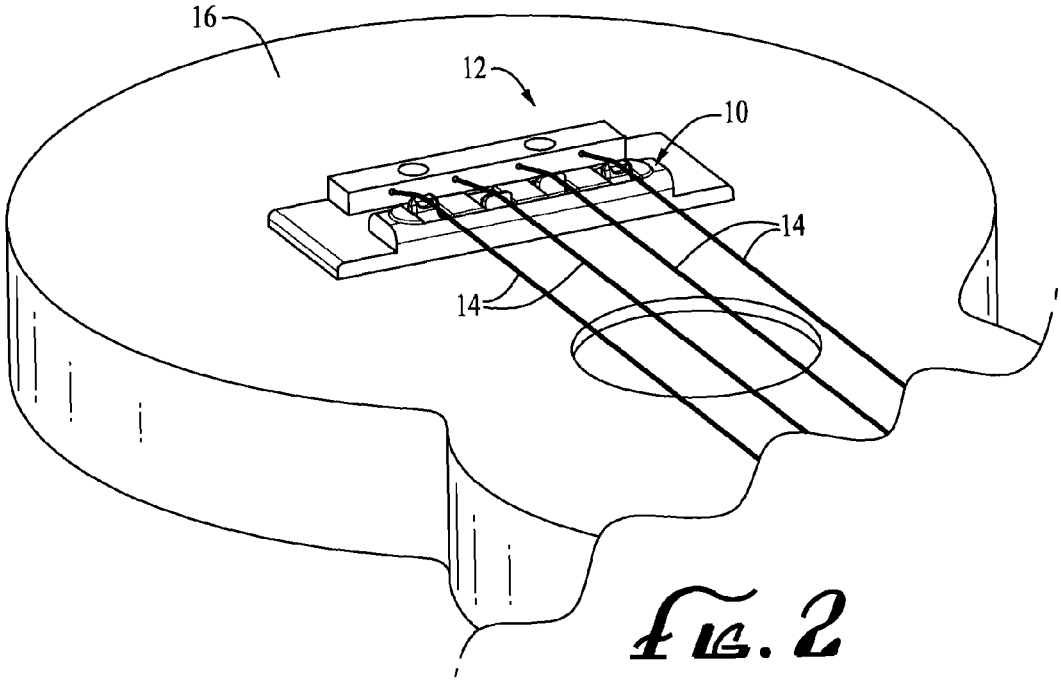
FIG. 2 is a perspective view of a musical instrument having the adjustable bridge illustrated in FIG. 1.
Figure 3:
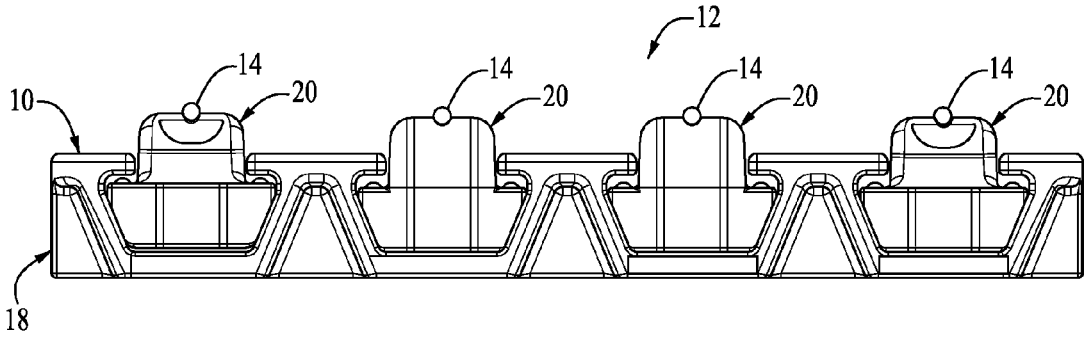
FIG. 3 is a front view of the adjustable bridge illustrated in FIG. 1.
Figure 4:
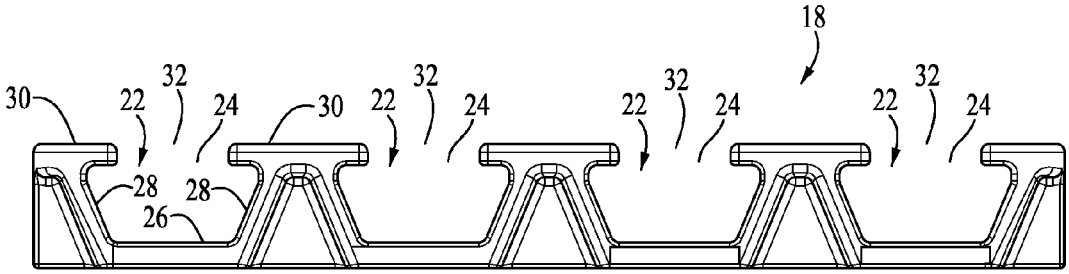
FIG. 4 is a front view of a saddle housing useable in the adjustable bridge of FIG. 1.
Figure 5A:
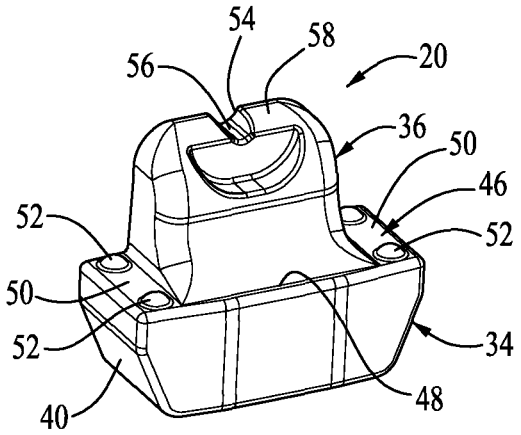
FIG. 5A is a perspective view of a saddle useable in the adjustable bridge of FIG. 1.
Figure 5B:
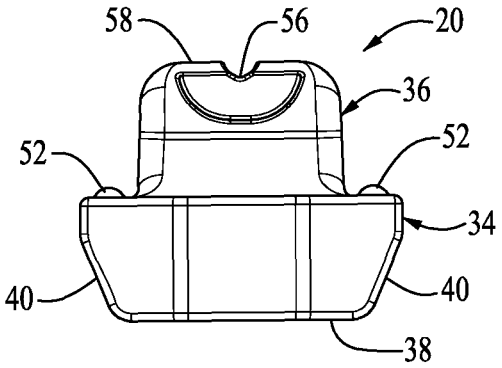
FIG. 5B is a front view of the saddle illustrated in FIG. 5A.
Figure 5C:
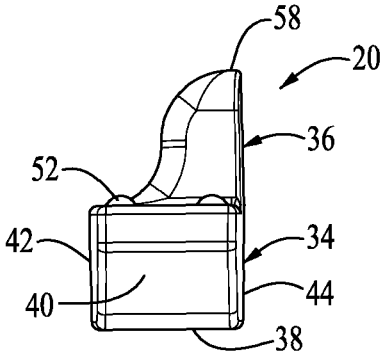
FIG. 5C is a side view of the saddle illustrated in FIG. 5A.
Figure 6A:
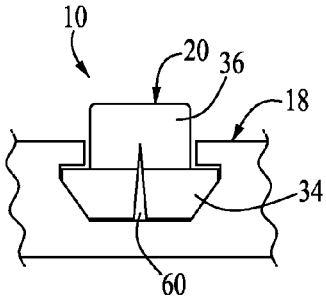
FIG. 6A is a front view sketch of a first alternative embodiment of an adjustable bridge having features of the invention.
Figure 6B:
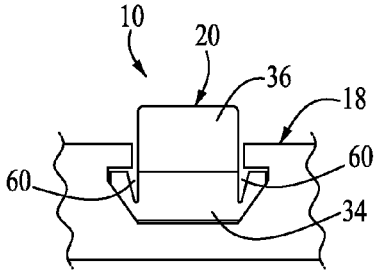
FIG. 6B is a front view sketch of a second alternative embodiment of an adjustable bridge having features of the invention.
Figure 6C:
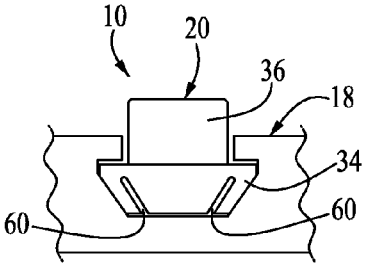
FIG. 6C is a front view sketch of a third alternative embodiment of an adjustable bridge having features of the invention.
Figure 6D:
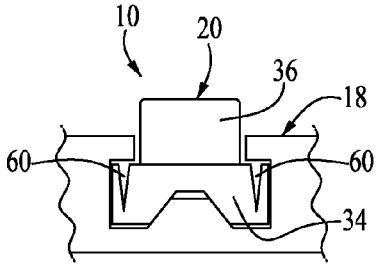
FIG. 6D is a front view sketch of a fourth alternative embodiment of an adjustable bridge having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an adjustable bridge 10 for a stringed musical instrument 12 wherein the stringed instrument 12 has instrument strings 14 tautly disposed between an instrument base 16 and an instrument neck (not shown). The adjustable bridge 10 of the invention comprises a saddle housing 18 and a plurality of saddles 20.

One embodiment of the invention is illustrated in FIGS. 1-5. In this embodiment, the saddle housing 18 has four saddle slots 22. Each saddle slot 22 defines an elongate space 24 having a bottom wall 26, a pair of opposed side walls 28 and a pair of opposed upper shoulders 30. The elongate space 24 defines a generally trapezoidal-shaped cross-section (perpendicular to the instrument strings 14). The opposed pair of upper shoulders 30 are disposed generally horizontally and, together, define an elongated top opening 32.

A saddle 20 is disposed within each saddle slot 22. Typically, one saddle 20 is provided for each of the instrument strings 14.

In the embodiments illustrated in FIGS. 1-8, each saddle 20 comprises a lower member 34 and an upper member 36. The lower member 34 is sized and dimensioned to approximately match the cross-section of each saddle slot 22. Accordingly, in the embodiments illustrated in FIGS. 1-8, the lower member 34 of each saddle 20 has a matching trapezoidally-shaped cross-section with a bottom wall 38, a pair of opposed side walls 40, a front wall 42, a rear wall 44 and a top wall 46. Each lower member 34 is sized and dimensioned to axially slide within a saddle slot 22. However, each member is also sized and dimensioned to essentially prevent movement of the saddle 20 within a saddle slot 22 in a direction perpendicular to the instrument strings 14 and to essentially prevent rotation of the saddle 20 within a saddle slot 22.

The top wall 46 of the lower member 34 has a central area 48 and a pair of opposed peripheral areas 50, each peripheral area 50 being disposed proximate to the side walls 40 of the lower member 34. The upper member 36 of the saddle 20 is disposed atop the central area 48 of the lower member 34 and is sized and dimensioned to protrude through the top opening 32 of each saddle slot 22.

In the embodiment illustrated in FIGS. 1-5, the top wall 46 of the lower member 34 is disposed slightly spaced apart from the inner surface of the opposed pair of upper shoulders 30. A pair of small rounded bumps 52 are disposed atop each peripheral area 50 of the top wall 46 of the lower member 34, one bump 52 disposed near each corner of the top wall 46. The bumps 52 are sized and dimensioned to be in close proximity to the inner surface of one of the upper shoulders 30, typically in contact with the inner surface of the upper shoulders 30, allowing the saddle 20 to be axially adjustable within a saddle slot 22 while essentially preventing the saddle 20 from rotating within a saddle slot 22 around the longitudinal axis of the elongate space 24.

In the embodiments illustrated in FIGS. 1-8, the upper member 36 of each saddle 20 is disposed towards the rear of the central area 48 of the lower member 34, such that the rear-most portion of the upper member 36 is essentially disposed in the same plane as the rear wall 44 of the lower member 34. Preferably, each saddle 20 can be removed from a saddle slot 22, rotated 180°, and reinserted within the saddle slot 22, to maximize useable intonation distances.

The upper member 36 has a string retaining sector 54 which can comprise a notch or hole, either defined within the upper member 36 or defined in an attachment to the upper member 36. The purpose of the string retaining sector 54 is to firmly retain an instrument string 14 which is tautly drawn across the saddle 20. In the embodiments illustrated in FIGS. 1-5, the string retaining sector 54 is a string retaining notch 56 which is defined within an uppermost periphery 58 of the upper member 36 of the saddle 20.

Each saddle 20 is axially adjustable within a saddle slot 22 in a direction substantially parallel to the strings 14 of the stringed instrument 12. Typically, each saddle 20 is firmly and solely retained within a saddle slot 22 by a tautly drawn instrument string 14 disposed across the saddle 20. Alternatively, the saddle housing 18 and each saddle 20 can be adapted to provide sufficient friction to firmly retain each saddle 20 within a saddle slot 22 by only frictional forces acting between the saddle 20 and the saddle slot 22. In this alternative embodiment, each saddle 20 is axially adjustable within the saddle slot 22 by pressure applied against the front wall 42 or rear wall 44 of the saddle 20. Typically, such pressure is provided by the user's finger, but, alternatively, can be provided by use of a small shaft, such as a small screwdriver shaft.

The saddles 20 and saddle slots 22 employ no springs, screws or other removable fasteners for the purpose of retaining a saddle 20 within a saddle slot 22.

FIGS. 6A-6D illustrate four additional alternative embodiments of the invention wherein one or more elongate compressible slits 60 are defined within each saddle 20 to allow each saddle 20 to be inwardly compressible, whereupon the side walls 40 of the saddle 20 are biased against the side walls 28 of a saddle slot 22. This provides additional friction for restricting the sliding movement of the saddles 20 within a saddle slot 22.

Additional friction can also be provided for restricting the movement of the saddles 20 within the saddle slots 22 by coating or lining the sides of each saddle 20 (and/or by coating or lining the sides of each saddle slot 22) with a material having an enhanced coefficient of friction.

Figure 7A:
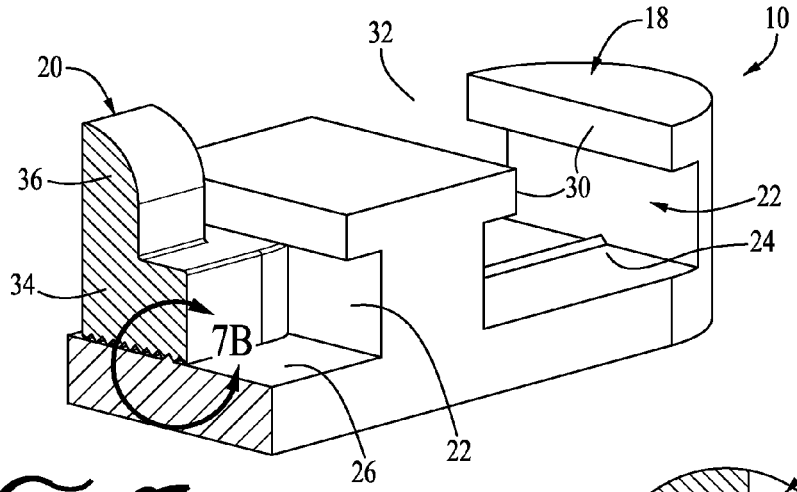
FIG. 7A is a perspective view of a fifth alternative embodiment of an adjustable bridge having features of the invention.
Figure 7B:
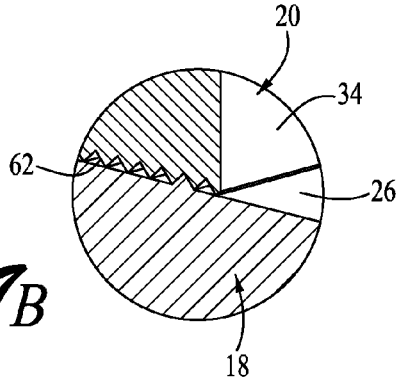
FIG. 7B is a detail view of the adjustable bridge of FIG. 7A illustrating the interaction between the bottom wall of the saddle and the bottom wall of the saddle slot.

FIGS. 7A and 7B illustrate another embodiment of the invention wherein the movement of the saddle 20 within the saddle slots 22 is not primarily constrained by frictional forces between the saddle walls and the saddle slots 22. Rather, the movement of the saddles 20 within the saddle slots 22 is primarily constrained by mechanical ridges 62 disposed within each one of the walls of each saddle slot 22 and/or within one of the walls of each saddle 20. Where such mechanical ridges 62 are disposed in the walls of the saddle slots 22, corresponding notches or bores are disposed in an abutting wall of each saddle 20. Conversely, when the mechanical ridges 62 are defined within the walls of each saddle 20, corresponding notches or bores are defined within abutting walls of the saddle slots 22.

In the embodiment illustrated in FIGS. 7A and 7B, such mechanical ridges 62 are provided by a plurality of triangular-shaped (in cross-section) ridges defined within a bottom wall 26 of each saddle slot 22. Each such ridge nests within a corresponding notch defined within the underside of each saddle 20. In other variations on this embodiment, the ridges can be provided by mechanical ridges 62 having cross-sections other than triangular cross-sections, such as rectangular or irregularly shaped cross-sections.

In yet other variations of this embodiment, the mechanical ridges 62 can be provided by a row of short prongs extending upwardly from the bottom of each saddle slot 22 into a corresponding row of bores disposed within the underside of each saddle 20. Alternatively, the mechanical ridges 62 can be provided by a row of prongs extending downwardly from the bottom wall 38 of each saddle 20 into a corresponding row of bores disposed within the underside of each saddle slot 22.

Figure 8:
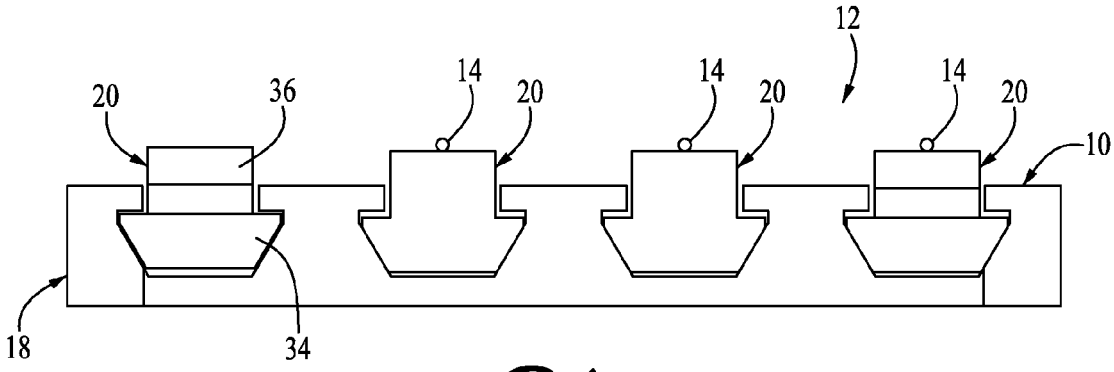
FIG. 8 is a front view sketch of a sixth alternative embodiment of an adjustable bridge having features of the invention.

FIG. 8 illustrates another embodiment of the invention, wherein each saddle 20 and each saddle slot 22 are sized and dimensioned such that each saddle 20 can be press-fit into a saddle slot 22 by pressing downwardly on the saddle 20.

Figure 9:
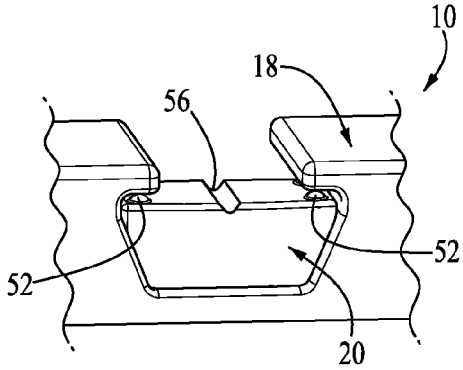
FIG. 9 is a perspective view of a seventh alternative embodiment of an adjustable bridge having features of the invention.

FIG. 9 illustrates yet another embodiment. In this embodiment, the saddles 20 have no upper member 36 protruding through the elongate top opening 32. Instead, the strings 14 of the musical instrument 12 are disposed below the top opening 32 to apply pressure to the top of the saddle 20.

The saddle housing 18 and the saddles 20 can be made from a wide variety of materials, such as metals, woods, bone, shell, plastics, ceramics, fibrous materials and/or combinations thereof.

The invention is especially useful for acoustical stringed instruments, such as ukeleles and guitars.

The adjustable bridge 10 of the invention is also especially useful when employed with the guitar nut described in U.S. Pat. No. 6,433,264, the entirety of which is incorporated herein by reference.

The inventors have found that the adjustable bridge 10 of the invention is both easier to use and less expensive to manufacture than adjustable bridges of the prior art.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An adjustable bridge for a stringed instrument having a plurality of instrument strings, the adjustable bridge comprising:

(a) a saddle housing defining at least one saddle slot, each saddle slot defining an elongate enclosed space with an elongate top opening; and (b) a saddle disposed within each saddle slot, each saddle being firmly retained within a saddle slot when a string is drawn tautly across the saddle, the saddle being axially adjustable within a saddle slot substantially parallel to a string of the stringed instrument when a string is not drawn tautly across the saddle;

wherein the saddle is alternatively firmly retained within a saddle slot and axially adjustable within the saddle slot without the use of set screws, detents, removable screws, other removable fasteners or tools.

2. The adjustable bridge of claim 1 wherein each saddle comprises a string retaining sector.

3. The adjustable bridge of claim 2 wherein the string retaining sector is a string retaining notch defined within an uppermost periphery of the saddle.

4. The adjustable bridge of claim 1 wherein the enclosed space of each saddle housing at least a portion of each saddle have matching generally trapezoid-shaped cross-sections.

5. The adjustable bridge of claim 1 wherein each saddle slot comprises a pair of opposed shoulder members disposed on opposite sides of the elongate top opening.

6. The adjustable bridge of claim 5 wherein each saddle has a top wall comprising a top wall central area and opposed top wall peripheral areas defined on opposite sides of the top wall central area, and wherein at least two bumps are disposed on each of the opposed top wall peripheral areas, each bump being disposed in close proximity to a shoulder member of a saddle slot.

7. The adjustable bridge of claim 5 wherein the lower portion of each saddle has a top wall comprising a top wall central area and opposed top wall peripheral areas defined on opposite sides of the top wall central area, the top wall central area having a forward portion and a rearward portion, the string retaining sector being disposed proximate to the forward portion or proximate to the rearward portion;

wherein each saddle can be removed from a saddle slot, rotated 180° and reinserted within that saddle slot.

8. The adjustable bridge of claim 1 wherein the lowermost portion of each saddle comprises ridges which cooperate with mechanical ridges in the lowermost portion of a saddle slot to inhibit the axial movement of the saddle within the saddle slot.

9. The adjustable bridge of claim 1 wherein each saddle and each saddle slot are sized and dimensioned such that each saddle can be press-fit into a saddle slot by pressing downwardly on the saddle.

10. The adjustable bridge of claim 9 wherein each saddle defines at least one elongate compressible slit disposed generally vertically so that the saddle can be inwardly compressed.

11. The adjustable bridge of claim 1 wherein each saddle comprises a lower portion and an upper portion, the lower portion being disposed within the enclosed space of a saddle slot and the upper portion being protruded above the lower portion through the top opening of the saddle slot.

12. A stringed instrument having a plurality of instruments strings, the stringed instrument comprising:

(a) the adjustable bridge of claim 1, and (b) an instrument string drawn tautly across each saddle to firmly retain each saddle within a saddle slot.

13. An adjustable bridge for a stringed instrument having a plurality of instrument strings, the adjustable bridge comprising:

(a) a saddle housing defining at least one saddle slot, each saddle slot defining an elongate enclosed space with an elongate top opening, each saddle slot comprising a pair of opposed shoulder members disposed on opposite sides of the elongate top opening; and (b) a saddle disposed within each saddle slot, each saddle comprising a lower portion and an upper portion with an upper portion apex, the lower portion being disposed within the enclosed space of a saddle slot and the upper portion being protruded above the lower portion through the top opening of the saddle slot, the upper portion of each saddle comprising a string retaining notch defined within an upper periphery of the upper portion, each saddle being axially adjustable within a saddle slot substantially parallel to a string of the stringed instrument without the use of set screws, detents, removable screws, other removable fasteners or tools;

wherein the enclosed space of each saddle housing and the lower portion of each saddle have matching generally trapezoidal cross-sections; and wherein the lower portion of each saddle has a top wall comprising a top wall central area and opposed top wall peripheral areas defined on opposite sides of the top wall central area, and wherein at least two bumps are disposed on each of the opposed top wall peripheral areas, each bump being disposed in close proximity to a shoulder member of a saddle slot.

14. The adjustable bridge of claim 13 wherein the lower portion of each saddle has a top wall comprising a top wall central area and opposed top wall peripheral areas defined on opposite sides of the top wall central area, the top wall central area having a forward portion and a rearward portion, the upper portion of the saddle being disposed above the rearward portion of the top wall central area.

15. The adjustable bridge of claim 13 wherein each saddle and each saddle slot is sized and dimensioned such that each saddle can be press-fit into a saddle slot by pressing downwardly on the saddle.

16. A stringed instrument having a plurality of instruments strings, the stringed instrument comprising:

(a) the adjustable bridge of claim 13, and (b) an instrument string drawn tautly across each saddle to firmly retain each saddle within a saddle slot.

17. An adjustable bridge for a stringed instrument having a plurality of instrument strings, the adjustable bridge comprising:

(a) a saddle housing defining at least one saddle slot, each saddle slot defining an elongate enclosed space with an elongate top opening; and (b) a saddle having a forward portion and a rearward portion, each saddle being firmly retained within a saddle slot by only frictional forces acting between the saddle and the saddle slot, each saddle being axially adjustable within a saddle slot substantially parallel to the string of the stringed instrument by pressure applied against the forward portion or rearward portion of the saddle;

wherein the saddle is both firmly retained within a saddle slot and axially adjustable within the saddle slot without the use of set screws, detents, removable screws or other removable fasteners.

18. The adjustable bridge of claim 17 wherein each saddle slot comprises a pair of opposed shoulder members disposed on opposite sides of the longitudinal top opening and wherein each saddle has a top wall comprising a top wall central area and opposed top wall peripheral areas defined on opposite sides of the top wall central area, and wherein at least two bumps are disposed on each of the opposed top wall peripheral areas, each bump being disposed in close proximity to a shoulder member of a saddle slot.

19. The adjustable bridge of claim 17 wherein each saddle and each saddle slot are sized and dimensioned such that each saddle can be press-fit into a saddle slot by pressing downwardly on the saddle.

20. A stringed instrument having a plurality of instruments strings, the stringed instrument comprising:

(a) the adjustable bridge of claim 17, and (b) an instrument string drawn tautly across each saddle.

* * * * *